US007364158B2

(12) United States Patent
Ishikawa et al.

(10) Patent No.: US 7,364,158 B2
(45) Date of Patent: Apr. 29, 2008

(54) CONVEYOR APPARATUS

(75) Inventors: Akira Ishikawa, Noda (JP); Kenji Fujiwara, Noda (JP)

(73) Assignee: Komori Corporation, Tokyo (JP)

( * ) Notice: Subject to any disclaimer, the term of this patent is extended or adjusted under 35 U.S.C. 154(b) by 292 days.

(21) Appl. No.: 11/116,362

(22) Filed: Apr. 28, 2005

(65) Prior Publication Data

US 2005/0242497 A1 Nov. 3, 2005

(30) Foreign Application Priority Data

Apr. 30, 2004 (JP) ..... 2004-136132

(51) Int. Cl.
*B65H 5/02* (2006.01)

(52) U.S. Cl. ..... 271/273; 271/270; 271/272; 271/202; 271/203

(58) Field of Classification Search ..... 271/270, 271/272, 69, 198, 202, 203; 198/626.5, 461.1, 198/588
See application file for complete search history.

(56) References Cited

U.S. PATENT DOCUMENTS 4,461,467 A * 7/1984 Herb ..... 271/202
4,913,415 A * 4/1990 Weber ..... 271/272
5,102,111 A * 4/1992 Reponty ..... 270/12
5,161,793 A * 11/1992 Lotto et al. ..... 271/182
5,386,984 A * 2/1995 Dal Toso et al. ..... 271/122
5,417,416 A * 5/1995 Marmin et al. ..... 271/270
5,536,001 A * 7/1996 Lange et al. ..... 271/202
6,019,714 A * 2/2000 Stab ..... 493/429
6,237,912 B1 * 5/2001 Motooka et al. ..... 271/273
6,349,937 B1 * 2/2002 Gammerler et al. ..... 271/302

FOREIGN PATENT DOCUMENTS

EP 0498068 A1 8/1992
JP 2-62456 B2 12/1990
JP 11-60056 A 3/1999

* cited by examiner

*Primary Examiner*—Patrick Mackey
*Assistant Examiner*—Luis A Gonzalez
(74) *Attorney, Agent, or Firm*—Birch, Stewart, Kolasch & Birch, LLP

(57) ABSTRACT

A conveyor apparatus includes a receiving clearance adjustment mechanism for adjusting the vertical clearance between portions of downstream-side upper belts, the portion being located furthest upstream with respect to the conveyance direction of signatures, and upstream-side lower belts. The conveyor apparatus also includes a separation start position adjustment mechanism for adjusting a position at which upstream-side upper belts start to separate away from a signature. The conveyer apparatus can convey sheets, while properly transferring them between upstream-side belts to downstream-side belts, without generation of unintended positional shift, even when changes arise in the thickness and/or length of the sheets.

9 Claims, 4 Drawing Sheets

CONVEYOR APPARATUS

The entire disclosure of Japanese Patent Application No. 2004-136132 filed on Apr. 30, 2004, including specification, claims, drawings and summary is incorporated herein by reference in its entirety.

BACKGROUND OF THE INVENTION

1. Field of the Invention

The present invention relates to a conveyor apparatus which includes paired upstream belts and paired downstream belts and in which sheets held between the upstream belts are successively transferred to the downstream belts, whereby the sheets are conveyed while their conveyance speed is changed. In particular, the present invention relates to a conveyor apparatus of such a type suitable for conveyance of sheets folded into signatures by means of a folder added to a rotary press or the like.

2. Description of the Related Art

In general, rotary presses are equipped with folders for folding printed web. Some folders are equipped with a conveyor apparatus for reducing the conveyance speed of signatures before they enter a folding stage. FIG. 4 shows an example conveyer apparatus provided in such a folder (see, for example, Japanese Patent Publication (kokoku) No. H2-62456 and Japanese Patent Application Laid-Open (kokai) No. H11-60056).

In FIG. 4, reference numeral 11 denotes a transfer cylinder; 12 and 13 each denote a set of upstream-side upper rollers; 19 denotes a set of upstream-side upper belts; 21 to 25 each denote a set of upstream-side lower rollers; 29 denotes a set of upstream-side lower belts; 31 to 33 each denote a set of downstream-side upper rollers; 39 denotes a set of downstream-side upper belts; 41 to 44 each denote a set of downstream-side lower rollers; and 49 denotes a set of downstream-side lower belts.

The upstream-side upper rollers 12 (13) are rotatably provided on an unillustrated support shaft at predetermined axial intervals. The upstream-side upper belts 19 are wound around the transfer cylinder 11 and the upstream-side upper rollers 12 and 13 so as to connect them.

The upstream-side lower rollers 21 (22-25) are rotatably provided on an unillustrated support shaft at axial intervals identical to those of the upstream-side upper rollers 12 (13) such that the upstream-side lower rollers 21 (22-25) are located in the same vertical planes in which the upstream-side upper rollers 12 (13) are located, respectively. The upstream-side lower belts 29 are wound around the upstream-side lower rollers 21 to 25 so as to connect them, whereby the upstream-side lower belts 29 face the corresponding upstream-side upper belts 19 and can nip a signature in cooperation therewith.

The downstream-side upper rollers 31 (32, 33) are rotatably provided on an unillustrated support shaft such that the downstream-side upper rollers 31 (32, 33) and the upstream-side upper belts 19 are alternately located. The downstream-side upper rollers 31 are located on the upstream side of the upstream-side upper rollers 12 and 13. The downstream-side upper belts 39 are wound around the downstream-side upper rollers 31 to 33 and other, unillustrated downstream-side upper rollers so as to connect them, whereby upstream portions of the downstream-side upper belts 39 are located in the corresponding spaces between the upstream-side upper belts 19; i.e., these upstream portions overlap the upstream-side upper belts 19 in the horizontal direction.

The downstream-side lower rollers 41 (42-44) are rotatably provided on an unillustrated support shaft such that the downstream-side lower rollers 41 (42-44) are located in the same vertical planes in which the downstream-side upper rollers 31 (32, 33) are located, respectively. The downstream-side lower rollers 41 are rotatably supported on the same support shaft of the upstream-side lower rollers 23. The downstream-side lower belts 49 are wound around the downstream-side lower rollers 41 to 44 and other, unillustrated downstream-side lower rollers so as to connect them. Thus, upstream portions of the downstream-side lower belts 49 are located in the corresponding spaces between the upstream-side lower belts 29; i.e., these upstream portions overlap the upstream-side lower belts 29 in the horizontal direction. Further, the downstream-side lower belts 49 face the corresponding downstream-side upper belts 39 and can nip a signature in cooperation therewith.

Of the downstream-side upper rollers 31 to 33, the upper rollers 31, located furthest upstream, are positioned such that portions of the downstream-side upper belts 39 located furthest upstream are located above the upstream-side upper belts 19. Meanwhile, of the upstream-side upper rollers 12 and 13, the upstream-side upper rollers 12, located on the downstream side of the upstream-side upper rollers 13, are positioned such that portions of the upstream-side upper belts 19 located furthest downstream are located above the downstream-side upper belts 39.

In such a conveyor apparatus, the upstream-side upper belts 19 and the upstream-side lower belts 29 are caused to travel at a speed corresponding to the circumferential speed of the transfer cylinder 11, and the downstream-side upper belts 39 and the downstream-side lower belts 49 are caused to travel at a speed slower than the traveling speed of the upstream-side belts 19 and 29. When a signature is transferred from the transfer cylinder 11 to be fed between the upstream-side belts 19 and 29, the signature is held between and conveyed by the upstream-side belts 19 and 29. As a result, the downstream-side upper belts 39 gradually come into contact with the signature, and after the signature is transferred from the upstream-side lower belts 29 to the downstream-side lower belts 49, the upstream-side upper belts 19 gradually separate away from the signature. Thus, the signature is properly transferred, without generation of unintended positional shift in the conveyance direction, and fed between the downstream-side belts 39 and 49, which are slower than the circumferential speed of the transfer cylinder 11, whereby the signature is conveyed to a folding stage.

Incidentally, the thickness and length in a conveyance direction of signatures transferred from the transfer cylinder 11 may change depending on folding specifications such as double folding, triple folding, or quarto folding, the specifications of paper, and the like. Therefore, when the folding specifications or the paper specifications are changed, in some case, a shift in the conveyance direction is produced when a signature is transferred from the upstream-side belts 19 and 29 to the downstream-side belts 39 and 49.

Such a problem may occur not only in a conveyer apparatus which conveys sheets folded into signatures by means of a folder attached to a rotary press or the like, but also other conveyor apparatuses, each of which includes paired upstream belts and paired downstream belts and in which sheets held between the upstream belts are successively transferred to the downstream belts, whereby the sheets are conveyed while their conveyance speed is changed.

SUMMARY OF THE INVENTION

In view of the foregoing, the present invention provides a conveyer apparatus which can convey sheets, while properly transferring them between upstream-side belts to downstream-side belts, without generation of unintended positional shift in the conveyance direction, even when changes arise in the thickness and/or length of the sheets.

In order to achieve the foregoing, a conveyor apparatus according to a first aspect of the present invention comprises upstream-side conveyance means for nipping a sheet between traveling upstream-side upper belts and upstream-side lower belts and conveying the sheet; and downstream-side conveyance means for nipping the sheet between traveling downstream-side upper belts and downstream-side lower belts and conveying the sheet at a speed different from the conveyance speed of the upstream-side conveyance means. With respect to the conveyance direction of the sheet, most upstream portions, of the downstream-side upper belts of the downstream-side conveyance means are located on the upstream side of most downstream portions, of the upstream-side lower belts of the upstream-side conveyance means, and form a first clearance in the vertical direction between the most upstream portions and the upstream-side lower belts. Most downstream portions of the upstream-side upper belts of the upstream-side conveyance means are located on the downstream side of most upstream portions of the downstream-side lower belts of the downstream-side conveyance means, and form a second clearance in the vertical direction between the most downstream portions and the downstream-side lower belts. The sheet having been nipped and conveyed between the upstream-side upper belts and the upstream-side lower belts of the upstream-side conveyance means is transferred to and conveyed between the downstream-side upper belts and the downstream-side lower belts of the downstream-side conveyance means. The conveyor apparatus further comprises receiving clearance adjustment means for adjusting the first clearance in the vertical direction between the most upstream portions of the downstream-side upper belts of the downstream-side conveyance means and the upstream-side lower belts of the upstream-side conveyance means.

According to a second aspect of the present invention, the conveyor apparatus according to the first aspect further comprises separation-start-position adjustment means for adjusting a position at which the upstream-side upper belts of the upstream-side conveyance means start to separate away from the sheet.

According to a third aspect of the present invention, in the conveyor apparatus according to the first aspect, the receiving clearance adjustment means comprises raising-lowering moving means for raising and lowering downstream-side upper rollers around which the downstream-side upper belts are wound and which are located furthest upstream.

According to a fourth aspect of the present invention, in the conveyor apparatus according to the second aspect, the separation-start-position adjustment means comprises adjustment rollers disposed between upstream-side upper rollers around which the upstream-side upper belts are wound and which are located furthest downstream and downstream-side upper rollers around which the downstream-side upper belts are wound and which are located furthest upstream, and adapted to press the upstream-side upper belts downward; and adjustment roller moving means for moving the adjustment rollers along the conveyance direction of the sheet.

According to a fifth aspect of the present invention, in the conveyor apparatus according to the fourth aspect, the adjustment rollers are located lower than the upstream-side upper rollers.

According to a sixth aspect of the present invention, in the conveyor apparatus according to the fourth aspect, the adjustment rollers are in contact with the upstream-side upper belts without contact with the downstream-side upper belts.

According to a seventh aspect of the present invention, in the conveyor apparatus according to the fourth aspect, the adjustment roller moving means comprises a guide shaft extending along the conveyance direction of the sheet; a slide block attached to the guide shaft such that the slide block is slidable along the guide shaft, the slide block rotatably supporting the adjustment rollers; and slide block moving means for moving the slide block along the guide shaft.

According to an eighth aspect of the present invention, in the conveyor apparatus according to the third aspect, the raising-lowering moving means comprises a pivot plate privotably supported and rotatably supporting the downstream-side upper rollers; and raising-lowering adjusting means for raising and lowering the downstream-side upper rollers, by pivoting the pivot plate, so as to adjust the first clearance.

According to a ninth aspect of the present invention, in the conveyor apparatus according to the third aspect, the raising-lowering moving means comprises retreat moving means for moving the downstream-side upper rollers, by pivoting the pivot plate, so as to retreat the downstream-side upper rollers to a retreat position.

According to a tenth aspect of the present invention, in the conveyor apparatus according to the eighth aspect, the raising-lowering adjusting means comprises a bracket rotatably connected to the pivot plate; a screw shaft rotatably supported on the bracket and being in screw engagement with a support member fixedly supported; and screw-shaft rotation means for rotating the screw shaft.

According to an eleventh aspect of the present invention, in the conveyor apparatus according to the eighth aspect, the raising-lowering adjusting means comprises a lever which pivots together with the pivot plate; a screw shaft having a tip end in contact with the lever and being in screw engagement with a support member fixedly supported.; and screw-shaft rotation means for rotating the screw shaft.

According to a twelfth aspect of the present invention, the conveyor apparatus according to the eleventh aspect further comprises an air cylinder for pivoting the lever.

According to a thirteenth aspect of the present invention, in the conveyor apparatus according to the first aspect, the downstream-side conveyance mean conveys the sheet at a speed slower than the conveyance speed of the upstream-side conveyance means.

The conveyer apparatus of the present invention can convey sheets, while properly transferring them between upstream-side belts to downstream-side belts, without generation of unintended positional shift with respect to the conveyance direction of the sheet, even when changes arise in the thickness and/or length of the sheets.

The present invention can be effectively applied to conveyer apparatus for conveying sheets folded into signatures by means of a folder added to a rotary press or the like, and can be beneficially utilized in the printing and bookmaking industries.

DESCRIPTION OF THE INVENTION

Figure 1:
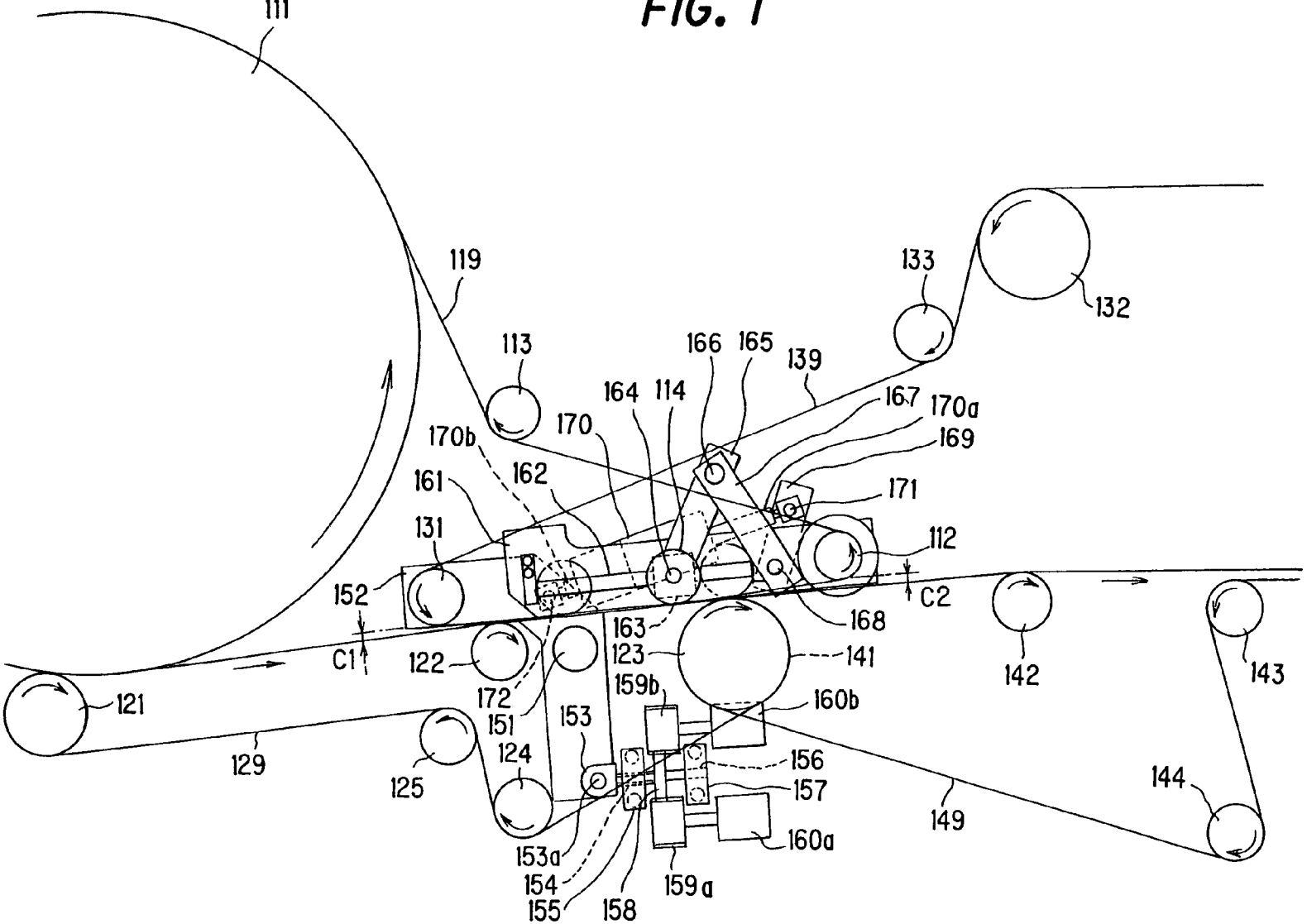
FIG. 1 is a schematic configurational view of a main portion of an embodiment of a conveyor apparatus according to the present invention.
Figure 2:
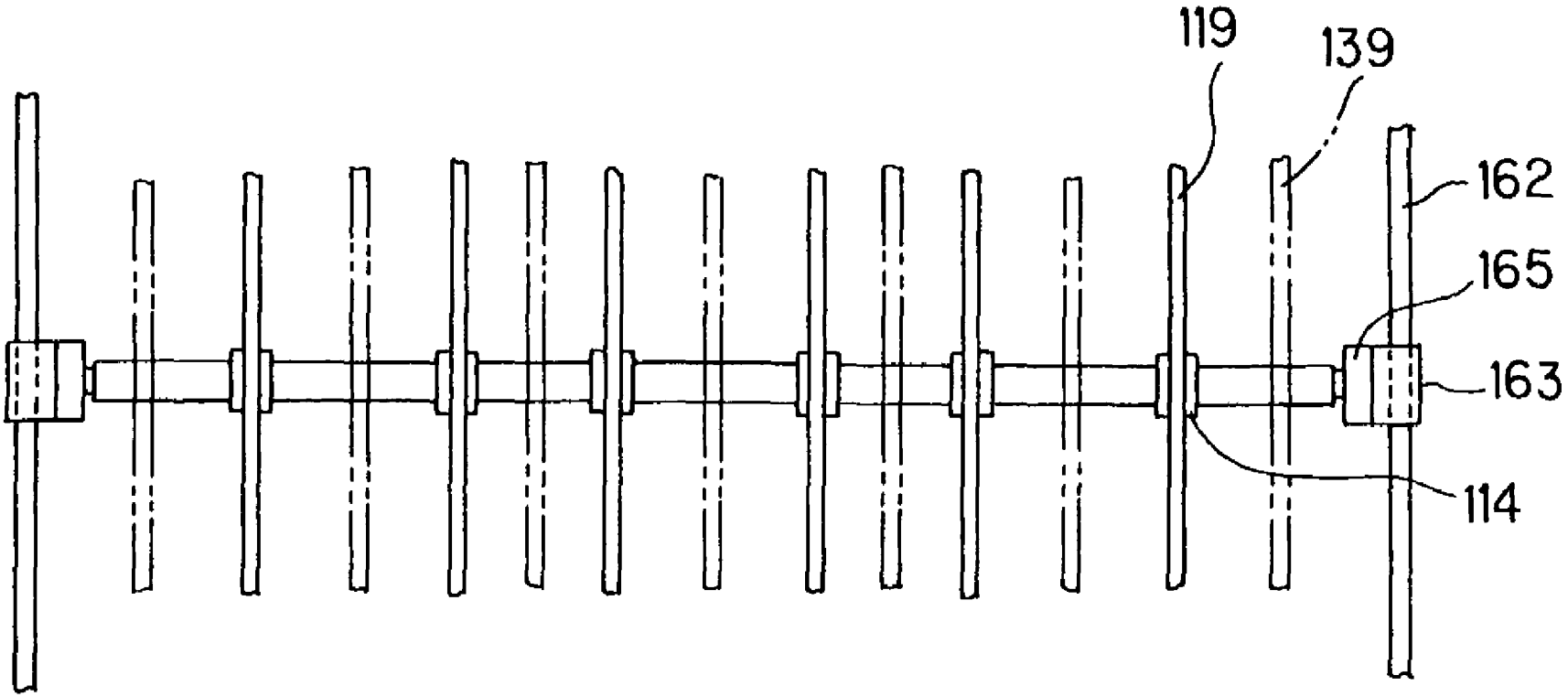
FIG. 2 is a partial plan view of a main portion of FIG. 1.

By reference to FIGS. 1 and 2, there will be described an embodiment in which a conveyor apparatus according to the present invention is used to convey sheets folded into signatures by means of a folder added to a rotary press or the like. FIG. 1 is a schematic configurational view of the conveyor apparatus, and FIG. 2 is a partial plan view of a main portion of FIG. 1.

In FIG. 1, reference numeral 111 denotes a transfer cylinder; 112 and 113 each denote a set of upstream-side upper rollers; 119 denotes a set of upstream-side upper belts; 121 to 125 each denote a set of upstream-side lower rollers; 129 denotes a set of upstream-side lower belts; 131 to 133 each denote a set of downstream-side upper rollers; 139 denotes a set of downstream-side upper belts; 141 to 144 each denote a set of downstream-side lower rollers; and 149 denotes a set of downstream-side lower belts.

The sets of upstream-side upper rollers 112 (113) are rotatably provided on respective unillustrated support shafts at predetermined axial intervals. The upstream-side upper belts 119 are wound around the transfer cylinder 111 and the upstream-side sets of upper rollers 112 and 113 so as to connect them.

The sets of upstream-side lower rollers 121 (122-125) are rotatably provided on respective unillustrated support shafts at axial intervals identical to those of the upstream-side sets of upper rollers 112 (113) such that the upstream-side lower rollers 121 (122-125) are located in the same vertical planes in which the upstream-side upper rollers 112 (113) are located, respectively. The upstream-side lower belts 129 are wound around the upstream-side sets of lower rollers 121 to 125 so as to connect them, whereby the upstream-side lower belts 129 face the corresponding upstream-side upper belts 119 and can nip a signature in cooperation therewith.

The sets of downstream-side upper rollers 131 (132, 133) are rotatably provided on respective unillustrated support shafts such that the downstream-side upper rollers 131 (132, 133) and the upstream-side upper belts 119 are alternately located. The downstream-side upper rollers 131 are located on the upstream side of the upstream-side upper rollers 112 and 113. The downstream-side upper belts 139 are wound around the downstream-side sets of upper rollers 131 to 133 and other, unillustrated downstream-side upper rollers so as to connect them, whereby upstream portions of the downstream-side upper belts 139 are located in the corresponding spaces between the upstream-side upper belts 119, as shown in FIG. 2.

The sets of downstream-side lower rollers 141 (142-144) are rotatably provided on respective unillustrated support shafts such that the downstream-side lower rollers 141 (142-144) are located in the same vertical planes in which the downstream-side upper rollers 131 (132, 133) are located, respectively. The downstream-side lower rollers 141 are rotatably supported on the same support shaft of the upstream-side lower rollers 123. The downstream-side lower belts 149 are wound around the downstream-side lower rollers 141 to 144 and other, unillustrated downstream-side lower rollers so as to connect them. Thus, upstream portions of the downstream-side lower belts 149 are located in the corresponding spaces between the upstream-side lower belts 129; i.e., these upstream portions coextend with the upstream-side lower belts 129 in the horizontal direction. Further, the downstream-side lower belts 149 face the corresponding downstream-side upper belts 139 and can hold a signature in cooperation therewith.

In the present embodiment, the transfer cylinder 111, the upstream-side upper rollers 112 and 113, the upstream-side upper belts 119, the upstream-side lower rollers 121 to 125, the upstream-side lower belts 129, etc. constitute upstream-side conveyance means; and the downstream-side upper rollers 131 to 133, the downstream-side upper belts 139, the upstream-side lower rollers 141 to 144, the downstream-side lower belts 149, etc. constitute downstream-side conveyance means.

Of the downstream-side upper rollers 131 to 133, the upper rollers 131, located furthest upstream, are supported, via a support shaft thereof, on a first end of an L-shaped pivot plate 152, which is pivotably supported at a central portion thereof by means of a pivot shaft 151.

A bracket 153 is rotatably connected to a second end of the pivot plate 152 via a pin 153*a*. One end of a screw shaft 154 is coupled to the bracket 153. The screw shaft 154 is in screw engagement with a support member 155 fixedly supported on an unillustrated frame. A support shaft 156 is coaxially connected to the other end of the screw shaft 154. The support shaft 156 is supported on a support member 157, which is fixedly supported on the unillustrated frame, such that the support shaft 156 is rotatable in the circumferential direction and is slidable along the axial direction.

A gear 158 is attached coaxially and integrally with the support shaft 156. Paired gears 159*a* and 159*b* are in meshing engagement with the gear 158. A shaft of a drive motor 160*a*, which is fixedly supported on the unillustrated frame, is coaxially connected to the gear 159*a*. A detection shaft of a rotary-type potentiometer 160*b*, which is fixedly supported on the unillustrated frame, is coaxially connected to the gear 159*b*.

Therefore, when the drive motor 160*a* is driven, the gear 159*a* rotates so as to rotate the gear 158, whereby the screw shaft 154 is rotated via the support shaft 156 and is axially moved with respect to the support member 155. As a result, the second end of the pivot plate 152 is pushed or pulled via the bracket 153 and the pin 153*a*, and thus, the first end of the pivot plate 152 pivotally moves about the pivot shaft 151, whereby, of the downstream-side upper rollers 131 to 133, the upper rollers 131, located furthest upstream, are raised or lowered. Through this operation, the vertical clearance (first clearance) Cl between the portions of the downstream-side upper belts 139 located furthest upstream and the upstream-side belts 119 and 129 can be adjusted. During this operation, the gear 159*b* rotates with rotation of the gear 158, and the detection shaft of the potentiometer 160*b* rotates, whereby the above-mentioned clearance (first clearance) C1 can be detected.

In the present embodiment, the support shaft 156, the support member 157, the gears 158 and 159*a*, the drive motor 160*a*, etc. constitute screw-shaft rotation means; the screw-shaft rotation means, the bracket 153, the pin 153*a*, the screw shaft 154, the support member 155, etc. constitute raising-lowering adjusting means; the raising-lowering adjusting means, the pivot shaft 151, the pivot plate 152, etc.

constitute raising-lowering moving means, serving as receiving-clearance adjustment means; and the gear 159*b*, the potentiometer 160*b*, etc. constitute receiving-clearance detection means.

Meanwhile, of the upstream-side upper rollers 112 and 113, the upstream-side upper rollers 112, located on the downstream side of the upstream-side upper rollers 113, are rotatably supported, via a support shaft thereof, on a guide frame 161, which is extended to the vicinity of the downstream-side upper rollers 131. The upstream-side upper rollers 112 are positioned such that a vertical clearance (second clearance) C2 is formed between the portions of the upstream-side upper belts 119 located furthest downstream and the downstream-side belts 139 and 149.

A guide shaft 162 is attached to one side surface of the guide frame 161, and extends between the opposite ends of the guide frame 161 such that its axis becomes parallel to the conveyance direction of the signatures. A slide block 163 is attached to the guide shaft 162 so as to be axially slidable along the guide shaft 162.

A first end of a link plate 165 is pivotally connected to the slide block 163 via a pin 164. A first end of a link plate 167 is pivotally connected to a second end of the link plate 165 via a pin 166. One end of a connection pin 168 is fixedly connected to a second end of the link plate 167. This connection pin 168 is rotatably supported on the guide frame 161 at a position near the rightward end of the guide shaft 162 as viewed in FIG. 1. The other end of the connection pin 168 passes through the guide frame 161, and projects from the opposite side surface of the guide frame 161.

A first end of a lever 169 disposed on the opposite side surface of the guide frame 161 is fixedly connected to the other end of the connection pin 168. The tip end of one rod 170*a* of a double air cylinder 170 is rotatably connected to a second end of the lever 169. The other rod 170*b* of the double air cylinder 170 is rotatably connected via a pin 172 to the opposite side surface of the guide frame 161 at a first end thereof (an end located near the downstream-side upper rollers 131).

Adjustment rollers 114 are rotatably supported on the slide block 163 via the above-mentioned pin 164 so as to slightly press the upstream-side upper belts 119 downward at a position between the upstream-side upper rollers 112 and the downstream-side upper rollers 131. The adjustment rollers 114 are located lower than the upstream-side upper rollers 112, and as shown in FIG. 2, arranged to come into contact with the upstream-side upper belts 119 without coming into contact with the downstream-side upper belts 139.

When the rods 170*a* and 170*b* of the double air cylinder 170 are extended or retreated, the orientation of the lever 169 is changed via the pin 171, and thus, the second end of the link plate 167 pivotally moves via the connection pin 168. As a result, the second end of the link plate 165 is pushed or pulled via the pin 166, and thus, the slide block 163 slides along the guide shaft 162 via the pin 164. Through this sliding movement, the position of the adjustment rollers 114 is switched so as to adjust the length, in the conveyance direction, of a region where the vertical clearance (second clearance) C2 is present between the downstream portions of the upstream-side upper belts 119 and the lower belts 129 and 149. In other words, the position at which the upstream-side upper belts 119 starts to separate away from the lower belts 129 and 149 can be adjusted.

In the present embodiment, the pins 164 and 166, the link plates 165 and 167, the connection pin 168, the lever 169, the double air cylinder 170, the pins 171 and 173, etc. constitute slide block moving means; the slide block moving means, the guide frame 161, the guide shaft 162, the slide block 163, etc. constitute adjustment roller moving means; and the adjustment roller moving means, the adjustment rollers 114, etc. constitute separation-start-position adjustment means.

In the conveyor apparatus of the present embodiment, the upstream-side upper belts 119 and the upstream-side lower belts 129 are caused to travel at a speed corresponding to the circumferential speed of the transfer cylinder 111, and the downstream-side upper belts 139 and the downstream-side lower belts 149 are caused to travel at a speed slower than the traveling speed of the upstream-side belts 119 and 129. When a signature is transferred from the transfer cylinder 111 to be fed between the upstream-side belts 119 and 129, the signature is held between and conveyed by the upstream-side belts 119 and 129. As a result, the downstream-side upper belts 139 gradually come into contact with the signature, and after the signature is transferred from the upstream-side lower belts 129 to the downstream-side lower belts 149, the upstream-side upper belts 119 gradually separate away from the signature. Thus, the signature is properly transferred, without generation of unintended positional shift in the conveyance direction, and is fed between the downstream-side belts 139 and 149 which are slower than the circumferential speed of the transfer cylinder 111, whereby the signature is conveyed to a folding stage.

When the folding specifications regarding signatures or the specifications of paper are changed, the following adjustment is performed for conveyance of signatures. Of the downstream-side upper rollers 131 to 133, the upper rollers 131, located furthest upstream, are moved through operation of the drive motor 160*a*, whereby the vertical clearance (first clearance) C1 between the portions of the downstream-side upper belts 139 located furthest upstream and the upstream-side belts 119 and 129 is adjusted in accordance with the thickness of each signature, which changes depending on the paper specifications and the folding specifications (double folding, triple folding, or quarto folding). Further, through changeover of the position of the adjustment rollers 114, effected upon extension or retreat of the rods 170*a* and 170*b* of the double air cylinder 170 as described above, the length, in the conveyance direction, of the region where the vertical clearance (second clearance) C2 is present between the downstream portions of the upstream-side upper belts 119 and the lower belts 129 and 149 is adjusted in accordance with the length of each signature in the conveyance direction, which length changes depending on the paper specifications and the folding specifications (double folding, triple folding, or quarto folding). In other words, the separation start position at which the upstream-side upper belts 119 starts to separate away from the lower belts 129 and 149 is adjusted.

Specifically, when signatures are thick, adjustment is performed so as to increase the first clearance C1, and when signatures are thin, adjustment is performed so as to decrease the first clearance C1. When signatures are long, the separation start position is shifted toward the upstream side with respect to the conveyance direction, and when signatures are short, the separation start position is shifted toward the downstream side with respect to the conveyance direction. That is, when signatures are double-folded, the adjustment rollers 114 are located at a left-hand position indicated by a long dashed double-short dashed line in FIG. 1; when signatures are triple-folded, the adjustment rollers 114 are located at a center position indicated by a solid line in FIG. 1; and when signatures are quarto-folded, the adjustment rollers 114 are located at a right-hand position indicated by a long dashed double-short dashed line in FIG. 1.

By virtue of the above-described adjustment, signatures can be transferred from the upstream-side belts 119 and 129 to the downstream-side belts 139 and 149, without generation of unintentional shift in the conveyance direction, even when the folding specifications, paper specifications, or the like of signatures transferred from the transfer cylinder 111 are changed.

Accordingly, the conveyer apparatus according to the present embodiment can convey sheets, while properly transferring them between upstream-side belts to downstream-side belts, without generation of unintended positional shift in the conveyance direction, even when the folding specifications of signatures or the specifications of paper are changed.

Figure 3:
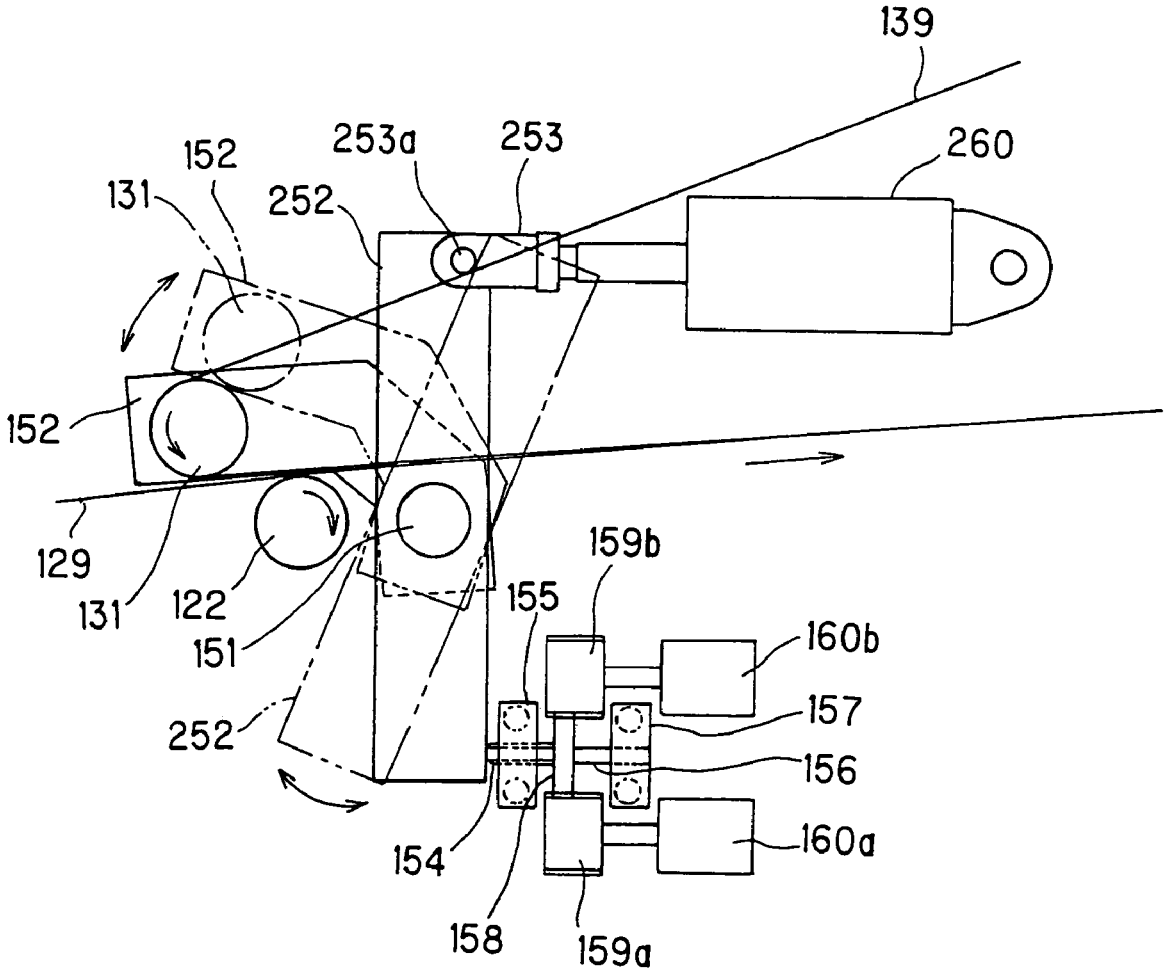
FIG. 3 is a schematic configurational view of a main portion of another embodiment of the conveyor apparatus according to the present invention.
Figure 4:
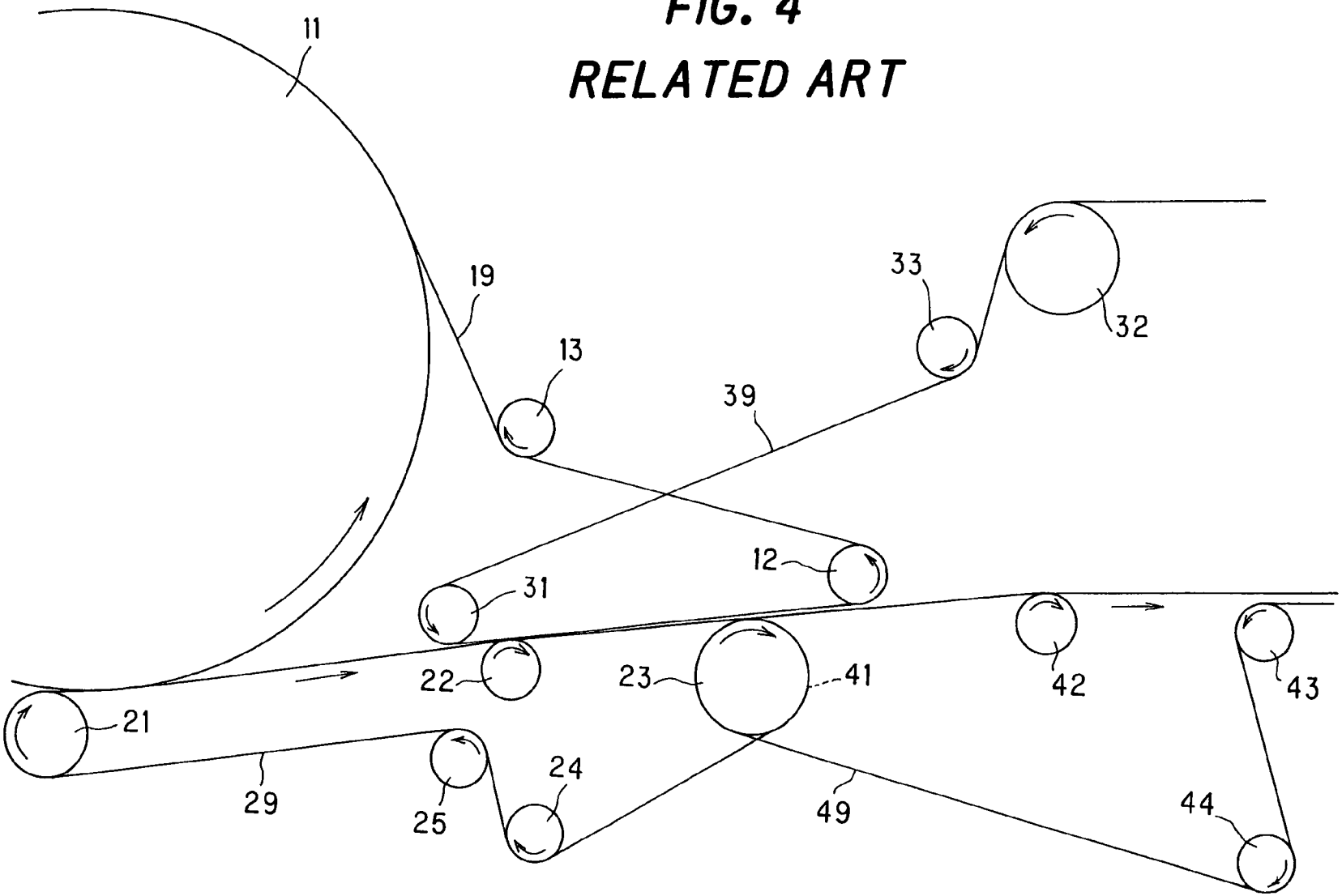
FIG. 4 RELATED ART
FIG. 4 is a schematic configurational view of a main portion of a conventional conveyor apparatus.

In the above-described embodiment, the pivot plate 152 and the screw shaft 154 are mutually connected via the bracket 153 and the pin 153*a*. However, for example, in the case where the downstream-side upper rollers 131 are required to be retreated over a large distance for maintenance or other purposes, the structure shown in FIG. 3 can be employed. The pivot plate 152 is fixedly supported on the pivot shaft 151, and an intermediate portion of a lever 252 is fixedly supported on the pivot shaft 151. A rod of an air cylinder 260 is connected to one end of the lever 252 via a bracket 253 and a pin 253*a*. The previously mentioned screw shaft 154 is brought into contact with the other end of the lever 252 without being fixed thereto. When the above-mentioned clearance is adjusted, the rod of the air cylinder 260 is caused to extend so as to axially move the screw shaft 154, while the air cylinder 260 is used as a damper. When the downstream-side upper rollers 131 are to be retreated over a large distance for maintenance or other purposes, the rod of the air cylinder 260 is caused to retreat so as to move the downstream-side upper rollers 131 to a retreat position (a position indicated by a long dashed double-short dashed line in FIG. 3), while separating the lever 252 from the screw shaft 154.

In this case, the bracket 253, the pin 253*a*, the air cylinder 260, etc. constitute lever pivoting means; the lever pivoting means, the lever 252, etc. constitute retreat moving means; the lever 252, the screw shaft 154, the screw-shaft rotation means, etc. constitute raising-lowering adjusting means; and the raising-lowering adjusting means, the retreat moving means, the pivot shaft 151, the pivot plate 152, etc. constitute the raising-lowering moving means.

What is claimed is:

1. A conveyor apparatus, comprising:

upstream-side conveyance means for nipping a sheet between traveling upstream-side upper belts and upstream-side lower belts and conveying said sheet;

downstream-side conveyance means for nipping said sheet between traveling downstream-side upper belts and downstream-side lower belts and conveying said sheet at a speed different from the conveyance speed of said upstream-side conveyance means;

separation-start-position adjustment means for adjusting a position at which said upstream-side upper belts of said upstream-side conveyance means start to separate away from said sheet, said separation-start-position adjustment means including, adjustment rollers disposed between upstream-side upper rollers around which said upstream-side upper belts are wound and which are located furthest downstream with respect to a conveyance direction of said sheet and downstream-side upper rollers around which said downstream-side upper belts are wound and which are located furthest upstream with respect said conveyance direction of said sheet, and adapted to press said upstream-side upper belts downward, and adjustment roller moving means for moving said adjustment rollers along said conveyance direction of said sheet, with respect to said conveyance direction of said sheet, most upstream portions, of said downstream-side upper belts of said downstream-side conveyance means being located on the upstream side, of most downstream portions of said upstream-side lower belts of said upstream-side conveyance means, and forming a first clearance in the vertical direction between said most upstream portions and said upstream-side lower belts, with respect to said conveyance direction of said sheet, most downstream portions, of said upstream-side upper belts of said upstream-side conveyance means being located on the downstream side of most upstream portions of said downstream-side lower belts of said downstream-side conveyance means, and forming a second clearance in the vertical direction between said most downstream portions and said downstream-side lower belts, and said sheet having been nipped and conveyed between said upstream-side upper belts and said upstream-side lower belts of said upstream-side conveyance means being transferred to and conveyed between said downstream-side upper belts and said downstream-side lower belts of said downstream-side conveyance means, wherein said conveyor apparatus further comprises receiving clearance adjustment means for adjusting said first clearance in the vertical direction between the most upstream portions of said downstream-side upper belts of said downstream-side conveyance means and said upstream-side lower belts of said upstream-side conveyance means.

2. A conveyor apparatus according to claim 1, wherein said adjustment rollers are located lower than said upstream-side upper rollers.

3. A conveyor apparatus according to claim 1, wherein said adjustment rollers are in contact with said upstream-side upper belts without contact with said downstream-side upper belts.

4. A conveyor apparatus according to claim 1, wherein said adjustment roller moving means comprises:

a guide shaft extending along said conveyance direction of said sheet;

a slide block attached to said guide shaft such that said slide block is slidable along said guide shaft, said slide block rotatably supporting said adjustment rollers; and slide block moving means for moving said slide block along said guide shaft.

5. A conveyor apparatus, comprising:

upstream-side conveyance means for nipping a sheet between traveling upstream-side upper belts and upstream-side lower belts and conveying said sheet; and downstream-side conveyance means for nipping said sheet between traveling downstream-side upper belts and downstream-side lower belts and conveying said sheet at a speed different from the conveyance speed of said upstream-side conveyance means, with respect to a conveyance direction of said sheet, most upstream portions, of said downstream-side upper belts of said downstream-side conveyance means being located on the upstream side, of most downstream portions of said upstream-side lower belts of said upstream-side conveyance means, and forming a first clearance in the vertical direction between said most upstream portions and said upstream-side lower belts, with respect to said conveyance direction of said sheet, most downstream portions, of said upstream-side upper belts of said upstream-side conveyance means being located on the downstream side of most upstream portions of said downstream-side lower belts of said downstream-side conveyance means, and forming a second clearance in the vertical direction between said most downstream portions and said downstream-side lower belts, and said sheet having been nipped and conveyed between said upstream-side upper belts and said upstream-side lower belts of said upstream-side conveyance means being transferred to and conveyed between said downstream-side upper belts and said downstream-side lower belts of said downstream-side conveyance means, wherein said conveyor apparatus further comprises receiving clearance adjustment means for adjusting said first clearance in the vertical direction between the most upstream portions of said downstream-side upper belts of said downstream-side conveyance means and said upstream-side lower belts of said upstream-side conveyance means, wherein said receiving clearance adjustment means comprises raising-lowering moving means for raising and lowering downstream-side upper rollers around which said downstream-side upper belts are wound and which are located furthest upstream with respect said conveyance direction of said sheet, wherein said raising-lowering moving means comprises, a pivot plate pivotably supported and rotatably supporting said downstream-side upper rollers, and raising-lowering adjusting means for raising and lowering said downstream-side upper rollers, by pivoting said pivot plate, so as to adjust said first clearance, and wherein said raising-lowering adjusting means comprises, a bracket rotatably connected to said pivot plate, a screw shaft rotatably supported on said bracket and being in screw engagement with a support member fixedly supported, and screw-shaft rotation means for rotating said screw shaft.

6. A conveyor apparatus, comprising:

upstream-side conveyance means for nipping a sheet between traveling upstream-side upper belts and upstream-side lower belts and conveying said sheet; and downstream-side conveyance means for nipping said sheet between traveling downstream-side upper belts and downstream-side lower belts and conveying said sheet at a speed different from the conveyance speed of said upstream-side conveyance means, with respect to a conveyance direction of said sheet, most upstream portions, of said downstream-side upper belts of said downstream-side conveyance means being located on the upstream side, of most downstream portions of said upstream-side lower belts of said upstream-side conveyance means, and forming a first clearance in the vertical direction between said most upstream portions and said upstream-side lower belts, with respect to said conveyance direction of said sheet, most downstream portions, of said upstream-side upper belts of said upstream-side conveyance means being located on the downstream side of most upstream portions of said downstream-side lower belts of said downstream-side conveyance means, and forming a second clearance in the vertical direction between said most downstream portions and said downstream-side lower belts, and said sheet having been nipped and conveyed between said upstream-side upper belts and said upstream-side lower belts of said upstream-side conveyance means being transferred to and conveyed between said downstream-side upper belts and said downstream-side lower belts of said downstream-side conveyance means, wherein said conveyor apparatus further comprises receiving clearance adjustment means for adjusting said first clearance in the vertical direction between the most upstream portions of said downstream-side upper belts of said downstream-side conveyance means and said upstream-side lower belts of said upstream-side conveyance means, wherein said receiving clearance adjustment means comprises raising-lowering moving means for raising and lowering downstream-side upper rollers around which said downstream-side upper belts are wound and which are located furthest upstream with respect said conveyance direction of said sheet, wherein said raising-lowering moving means comprises, a pivot plate pivotably supported and rotatably supporting said downstream-side upper rollers, and raising-lowering adjusting means for raising and lowering said downstream-side upper rollers by adjusting a position of said pivot plate, so as to adjust said first clearance, and wherein said raising-lowering adjusting means comprises, a lever which pivots together with said pivot plate, a screw shaft having a tip end in contact with said lever and being in screw engagement with a support member fixedly supported, and screw-shaft rotation means for rotating said screw shaft.

7. A conveyor apparatus according to claim 6, further comprising:

an air cylinder for pivoting said lever.

8. A conveyor apparatus, comprising:

upstream-side conveyance means for nipping a sheet between traveling upstream-side upper belts and upstream-side lower belts and conveying said sheet; and downstream-side conveyance means for nipping said sheet between traveling downstream-side upper belts and downstream-side lower belts and conveying said sheet at a speed different from the conveyance speed of said upstream-side conveyance means, with respect to a conveyance direction of said sheet, most upstream portions, of said downstream-side upper belts of said downstream-side conveyance means being located on the upstream side, of most downstream portions of said upstream-side lower belts of said upstream-side conveyance means, and forming a first clearance in the vertical direction between said most upstream portions and said upstream-side lower belts, with respect to said conveyance direction of said sheet, most downstream portions, of said upstream-side upper belts of said upstream-side conveyance means being located on the downstream side of most upstream portions of said downstream-side lower belts of said downstream-side conveyance means, and forming a second clearance in the vertical direction between said most downstream portions and said downstream-side lower belts, and said sheet having been nipped and conveyed between said upstream-side upper belts and said upstream-side lower belts of said upstream-side conveyance means being transferred to and conveyed between said downstream-side upper belts and said downstream-side lower belts of said downstream-side conveyance means, wherein said conveyor apparatus further comprises receiving clearance adjustment means for adjusting said first clearance in the vertical direction between the most upstream portions of said downstream-side upper belts of said downstream-side conveyance means and said upstream-side lower belts of said upstream-side conveyance means, wherein said receiving clearance adjustment means comprises raising-lowering moving means for raising and lowering downstream-side upper rollers around which said downstream-side upper belts are wound and which are located furthest upstream with respect said conveyance direction of said sheet, and wherein said raising-lowering moving means comprises, a pivot plate pivotably supported and rotatably supporting said downstream-side upper rollers, and raising-lowering adjusting means including a screw shaft for adjusting the position of said pivot plate so as to adjust said first clearance.

9. A conveyor apparatus according to claim 8, wherein said screw shaft is an adjustable stopper that abuts said pivot plate.

* * * * *